US008462095B2

(12) United States Patent
Yang et al.

(10) Patent No.: US 8,462,095 B2
(45) Date of Patent: Jun. 11, 2013

(54) DISPLAY APPARATUS COMPRISING DRIVING UNIT USING SWITCHING SIGNAL GENERATING UNIT AND METHOD THEREOF

(75) Inventors: Jin-Wook Yang, Suwon-si (KR); Hyun Lee, Seoul (KR); Dae-Young Joung, Seoul (KR)

(73) Assignee: Samsung Display Co., Ltd. (KR)

( * ) Notice: Subject to any disclaimer, the term of this patent is extended or adjusted under 35 U.S.C. 154(b) by 783 days.

(21) Appl. No.: 12/564,310

(22) Filed: Sep. 22, 2009

(65) Prior Publication Data

US 2010/0085336 A1 Apr. 8, 2010

(30) Foreign Application Priority Data

Oct. 6, 2008 (KR) ..... 10-2008-0097750

(51) Int. Cl.
*G09G 3/36* (2006.01)

(52) U.S. Cl.
USPC ..... 345/100

(58) Field of Classification Search
USPC ..... 345/87–103, 204
See application file for complete search history.

(56) References Cited

U.S. PATENT DOCUMENTS

| | | | | |
|---|---|---|---|---|
| 6,052,426 | A | 4/2000 | Maurice | |
| 7,030,843 | B2 * | 4/2006 | Youn | 345/86 |
| 7,030,865 | B2 * | 4/2006 | Ishiyama | 345/204 |
| 7,079,103 | B2 * | 7/2006 | Morita | 345/98 |
| 2001/0009411 | A1 * | 7/2001 | Kusanagi | 345/93 |
| 2005/0001798 | A1 * | 1/2005 | Nohtomi et al. | 345/87 |
| 2006/0274013 | A1 | 12/2006 | Lin et al. | |
| 2007/0001978 | A1 * | 1/2007 | Cho | 345/98 |
| 2007/0200815 | A1 | 8/2007 | Yeh | |

FOREIGN PATENT DOCUMENTS

| | | |
|---|---|---|
| KR | 1020060060072 | 6/2006 |
| KR | 1020080017988 | 2/2008 |

* cited by examiner

*Primary Examiner* — Chanh Nguyen
*Assistant Examiner* — James Nokham
(74) *Attorney, Agent, or Firm* — Cantor Colburn LLP

(57) ABSTRACT

A driving unit includes a timing controller, a data driver having a data processor and a switching circuit, and a gate driver. The timing controller outputs image data, a data control signal, a gate control signal and a switching signal. The data processor converts the image data into a data voltage based on the data control signal, and the switching circuit receives the data voltage and a common voltage having a predetermined period and outputs either the common voltage or the data voltage in response to the switching signal. The gate driver outputs a gate voltage in response to the gate control signal. The timing controller outputs the switching signal at a time point in a first half period of a transition period of the common voltage, and the switching circuit outputs the common voltage at the time point.

23 Claims, 6 Drawing Sheets

DISPLAY APPARATUS COMPRISING DRIVING UNIT USING SWITCHING SIGNAL GENERATING UNIT AND METHOD THEREOF

This application claims priority to Korean Patent Application No. 2008-97750, filed on Oct. 6, 2008, and all the benefits accruing therefrom under 35 U.S.C. §119, the contents of which in its entirety are herein incorporated by reference.

BACKGROUND OF THE INVENTION

1. Field of the Invention

The present invention relates to a driving unit and a display apparatus having the same. More particularly, the present invention relates to a driving unit having a substantially reduced power consumption and a display apparatus having the driving unit.

2. Description of the Related Art

In general, a liquid crystal display includes a color filter substrate, an array substrate facing the color filter substrate, and a liquid crystal layer disposed between the color filter substrate and the array substrate. The color filter substrate typically includes a color filter layer and a common electrode, and the array substrate typically includes a pixel electrode facing the common electrode.

The common electrode and the pixel electrode receive a common voltage and a data voltage, respectively, and an electric field is thereby generated between the pixel electrode and the common electrode due to a potential difference between the data voltage and the common voltage. Liquid crystal molecules in the liquid crystal layer are aligned by the electric field, and the liquid crystal display controls light transmittance through the liquid crystal layer to display a desired image.

However, when data voltages having the same polarity (with respect to the common voltage) are continuously applied to the pixel electrode every frame, the liquid crystal molecules in the liquid crystal layer deteriorate. To prevent deterioration of the liquid crystal molecules, a liquid crystal display is often driven in an inversion drive scheme.

The inversion drive scheme is classified into either a frame inversion drive scheme or a line inversion drive scheme. In the frame inversion drive scheme, a polarity of the data voltage (with respect to a direct current common voltage) is inverted every frame. In the line inversion drive scheme, a polarity of the data voltage (with respect to an alternating current common voltage) is inverted every one or more lines.

Thus deterioration of the liquid crystal molecules is reduced in the inversion drive scheme. However, when the polarity of the data voltage is inverted every one or more lines, current consumption substantially increases since a time required for transition of the data voltage between polarities substantially increases.

BRIEF SUMMARY OF THE INVENTION

Therefore, an exemplary embodiment of the present invention provides a driving unit having advantages which include, but are not limited to, substantially reduced power consumption.

An alternative exemplary embodiment of the present invention provides a display apparatus having the driving unit.

Another alternative exemplary embodiment of the present invention provides a method of driving the display apparatus.

In an exemplary embodiment of the present invention, a driving unit includes a timing controller, a data driver and a gate driver. The timing controller outputs image data, a data control signal, a gate control signal, a first switching signal and a second switching signal. The data driver includes a data processor and a switching circuit. The data processor converts the image data into a data voltage based on the data control signal and the switching circuit receives the data voltage and a common voltage having a predetermined period and outputs either the common voltage or the data voltage in response to one of the first switching signal and the second switching signal.

The gate driver outputs a gate voltage in response to the gate control signal.

The timing controller outputs one of the first switching signal and the second switching signal at a time point in a first half period of a transition period of the common voltage. The switching circuit outputs the common voltage in response to one of the first switching signal and the second switching signal at the time point.

In an alternative exemplary embodiment of the present invention, a display apparatus includes a timing controller, a data driver, a gate driver and a display panel. The timing controller outputs an image data, a data control signal, a gate control signal, a first switching signal and a second switching signal. The data driver includes a data processor and a switching circuit. The data processor converts the image data into a data voltage based on the data control signal and the switching circuit receives the data voltage and a common voltage having a predetermined period and outputs either the common voltage or the data voltage in response to one of the first switching signal and the second switching signal. The gate driver outputs a gate voltage in response to the gate control signal. The display panel receives the data voltage from the switching circuit in response to the gate voltage and charges the data voltage into a pixel to display an image.

The timing controller outputs one of the first switching signal and the second switching signal at a time point in a first half period of a transition period of the common voltage. The switching circuit outputs the common voltage in response to one of the first switching signal and the second switching signal at the time point to precharge the pixel.

In another alternative exemplary embodiment of the present invention, a method of driving a display apparatus includes: generating an image data, a data control signal, a gate control signal, a gate control signal and a switching signal; converting the image data into a data voltage based on the data control signal; outputting the data voltage in response to a first state of the switching signal; outputting the common voltage at a time point in an earlier half period of a transition period of a common voltage having a predetermined period in response to a second state of the switching signal; outputting a gate signal in response to the gate control signal; precharging a pixel with the common voltage; and applying the data voltage to the pixel in response to the gate signal to display an image corresponding to the data voltage.

Thus, according to exemplary embodiments of the present invention, a timing controller outputs a switching signal at a time point in a transition period of a common voltage, at which the common voltage is closest to a voltage level of a next data voltage output from a data processor, and a switching circuit in the data driver outputs the common electrode at the time point. Accordingly, a transition time of the data voltage is substantially reduced, thereby substantially reducing current consumption of the driving unit.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
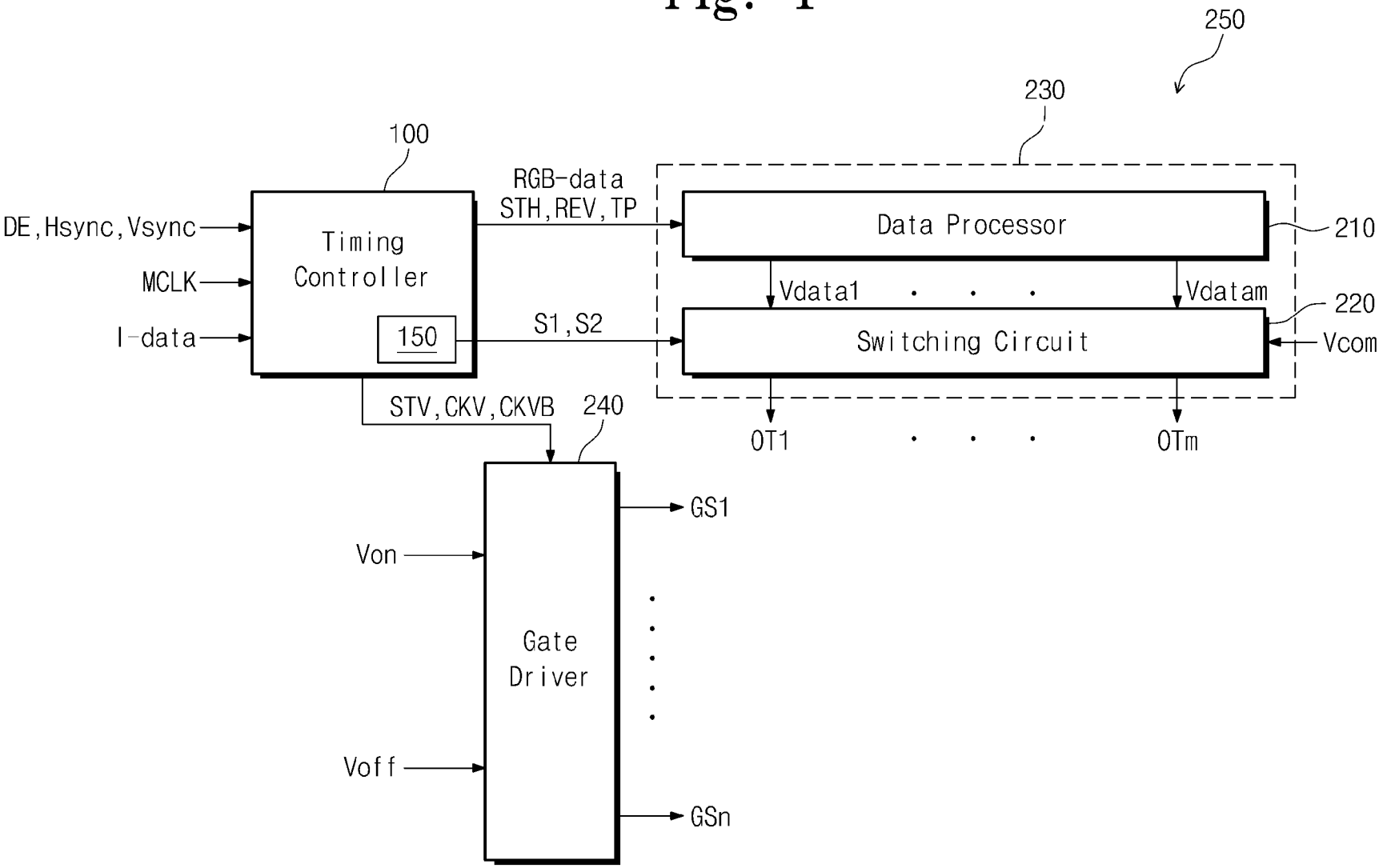
FIG. 1 is a block diagram showing an exemplary embodiment of a driving unit of a liquid crystal display panel according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

Figure 2:
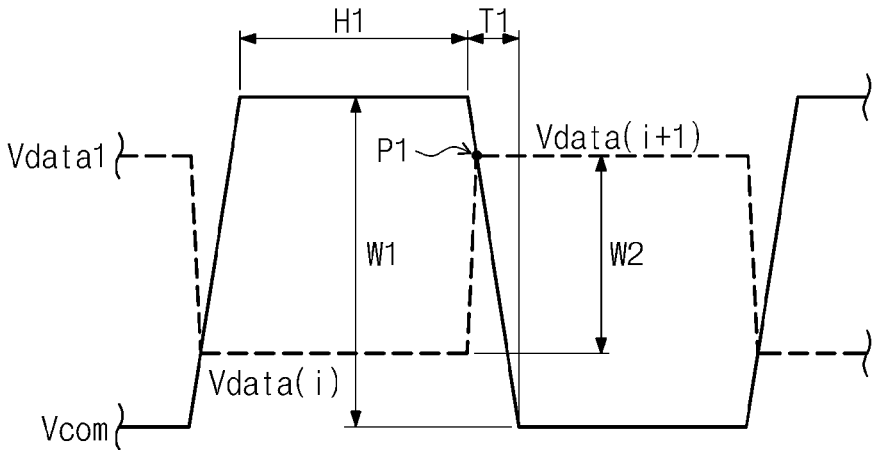
FIG. 2 is a signal timing diagram of an exemplary embodiment of a common voltage and a data voltage of the driving unit shown in FIG. 1.

FIG. 1 is a block diagram showing an exemplary embodiment of a driving unit of a liquid crystal display panel according to the present invention, and FIG. 2 is a signal timing diagram of a common voltage and a data voltage of the driving unit shown in FIG. 1.

Referring to FIG. 1, a driving unit 250 includes a timing controller 100, a data driver 230 and a gate driver 240.

The timing controller 100 receives a data enable signal DE, a vertical synchronization signal Vsync, a horizontal synchronization signal Hsync, a main clock signal MCLK and image data I-data. The timing controller 100 converts the image data I-data into red, green and blue data RGB-data and provides the red, green and blue data RGB-data to the data driver 230. The timing controller 100 generates a data control signal and a gate control signal (both described in further detail below) using the data enable signal DE, the main clock signal MCLK, the vertical synchronization signal Vsync and the horizontal synchronization signal Hsync and outputs the data control signals and gate control signals to the data driver 230 and the gate driver 240, respectively. In addition, the timing controller 100 includes a switching signal generating unit 150 which generates a first switching signal S1 and a second switching signal S2 and provides the first switching signal S1 and the second switching signal S2 to the data driver 230. The switching signal generating unit 150 will be described in further detail below with reference to FIG. 3.

The data driver 230 according to an exemplary embodiment includes a data processor 210 and a switching circuit 220. The data processor 210 receives the data control signal and the red, green and blue data RGB-data from the timing controller 100 and outputs a plurality of data voltages Vdata1-Vdatam. In an exemplary embodiment, the data control signal includes a horizontal start signal STH, a reverse signal REV and an output start signal TP. The horizontal start signal STH starts an operation of the data driver 230, the reverse signal REV reverses a polarity of each data voltage Vdata1-Vdatam of the plurality of data voltages Vdata1-Vdatam, and the output start signal TP determines an output timing of the data voltages Vdata1-Vdatam from the data processor 210.

The data voltages Vdata1-Vdatam output from the data processor 210 are supplied to the switching circuit 220. The switching circuit 220 receives a common voltage Vcom as well as the first switching signal S1 and the second switching signal S2 from the timing controller 100. The switching circuit 220 is connected to output terminals OT1-OTm of the data driver 230, as shown in FIG. 1.

In operation, the switching circuit 220 according to an exemplary embodiment outputs either the data voltages Vdata1-Vdatam or, alternatively, the common voltage Vcom to the output terminals OT1-OTm, respectively, based on the first switching signal S1 and the second switching signal S2.

As shown in FIG. 2, the common voltage Vcom is an alternating-current voltage which swings, e.g., alternates, in predetermined time periods. In the exemplary embodiment shown in FIG. 2, a first data voltage Vdata1 of the plurality of data voltages Vdata1-Vdatam is shown, but it will be understood that other data voltages of the plurality of data voltages Vdata1-Vdatam have substantially the same pulse shape as the first data voltage Vdata1.

Referring now to FIG. 2, the common voltage Vcom in an exemplary embodiment has a first amplitude W1 and the first data voltage Vdata1 has a second amplitude W2. In an exemplary embodiment, the second amplitude W2 is less than the first amplitude W1, as shown in FIG. 2. More particularly, the first data voltage Vdata1 swings, e.g., alternates, in a same range in which the common voltage Vcom swings.

In an exemplary embodiment, the common voltage Vcom has periods, and each period includes a voltage maintaining period H1, during which a predetermined voltage level is maintained, and a transition period T1, during which the predetermined voltage level changes. In addition, the first data voltage Vdata1 swings to have a phase opposite to a phase of the common voltage Vcom, and a polarity of the first data voltage Vdata1 (with respect to the common voltage Vcom) is thereby inverted at each half period of the common voltage Vcom. The half period of the common voltage Vcom is the same as a horizontal scanning period (hereinafter referred to as a high period of a gate signal).

In an exemplary embodiment, a data voltage generated during the high period of a present gate signal is defined as a present data voltage Vdata(i), while a data voltage generated during the high period of a next gate signal, e.g., an adjacent and temporally subsequent gate signal, is defined as a next data voltage Vdata(i+1). Moreover, the present data voltage Vdata(i) has a polarity opposite to a polarity of the next data voltage Vdata(i+1), as shown in FIG. 2.

The present data voltage Vdata(i) and the next data voltage Vdata(i+1) have different polarities and, as a result, a time required for transition of the data voltage, e.g., from the present data voltage Vdata(i) to the next data voltage Vdata (i+1), increases, thereby causing an increase in electric current consumption.

Accordingly, the switching circuit 220 according to an exemplary embodiment outputs the present data voltage Vdata(i) during the voltage maintaining period H1 and outputs the common voltage Vcom having a predetermined voltage level at a predetermined time point during an earlier half period within the transition period T1 (during which a polarity of the common voltage Vcom is inverted). Thus, to reduce a transition time of the data voltage, the switching circuit 220 according to an exemplary embodiment selects the common voltage Vcom instead of the present data voltage Vdata(i) at a time point P1 (FIG. 2) when a level of the common voltage Vcom is closest to the next data voltage Vdata(i+1), e.g., is substantially equal to the next data voltage Vdata(i+1), during the transition period T1 and outputs the selected common voltage Vcom to the first output terminal OT1 of the data driver 230.

As shown in FIG. 2, the common voltage Vcom has a phase opposite to a phase of the first data voltage Vdata1, and the common voltage Vcom has a voltage level closest to the next data voltage Vdata(i+1) during an earlier half period of the transition period T1, e.g., at the time point P1, rather than during a later half period of the transition period T1. Thus, the common voltage Vcom is output at the time point P1 instead of the present data voltage Vdata(i), and a time during which the present data voltage Vdata(i) is transitioning to the next data voltage Vdata(i+1) is thereby substantially reduced, thereby substantially reducing current consumption in the driving unit 250 according to an exemplary embodiment of the present invention.

Referring again to FIG. 1, the gate driver 240 receives a gate on voltage Von and a gate off voltage Voff and outputs a plurality of gate signals GS1-GSn in response to the gate control signal. In an exemplary embodiment, the gate control signal includes a vertical start signal STV, a first clock signal CKV and a second clock signal CKVB. The vertical start signal STV starts an operation of the gate driver 240, while the first clock signal CKV and the second clock signal CKVB determine an output timing of gate signals GS1-GSn of the plurality of gate signals GS1-GSn outputted from the gate driver 240.

Figure 3:
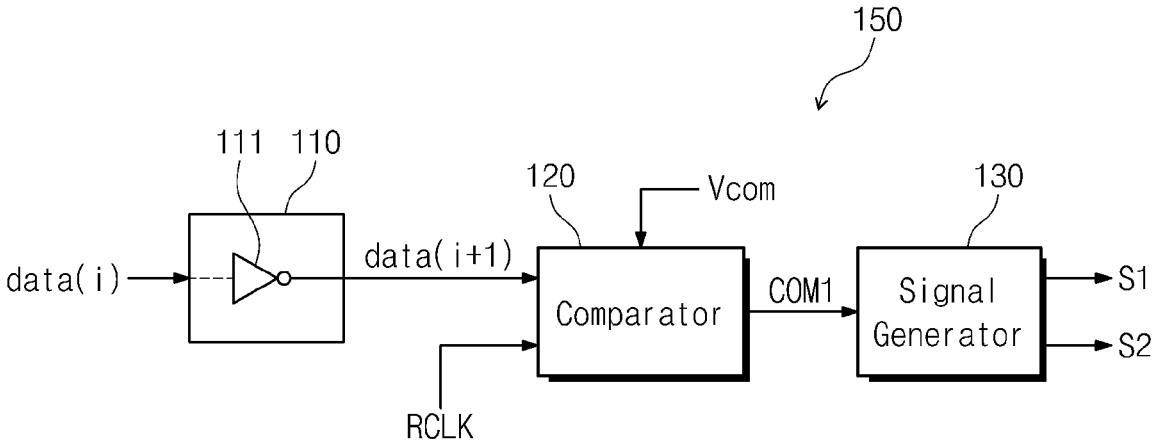
FIG. 3 is a block diagram showing an exemplary embodiment of a switching signal generating unit of the driving unit shown in FIG. 1.
Figure 4:
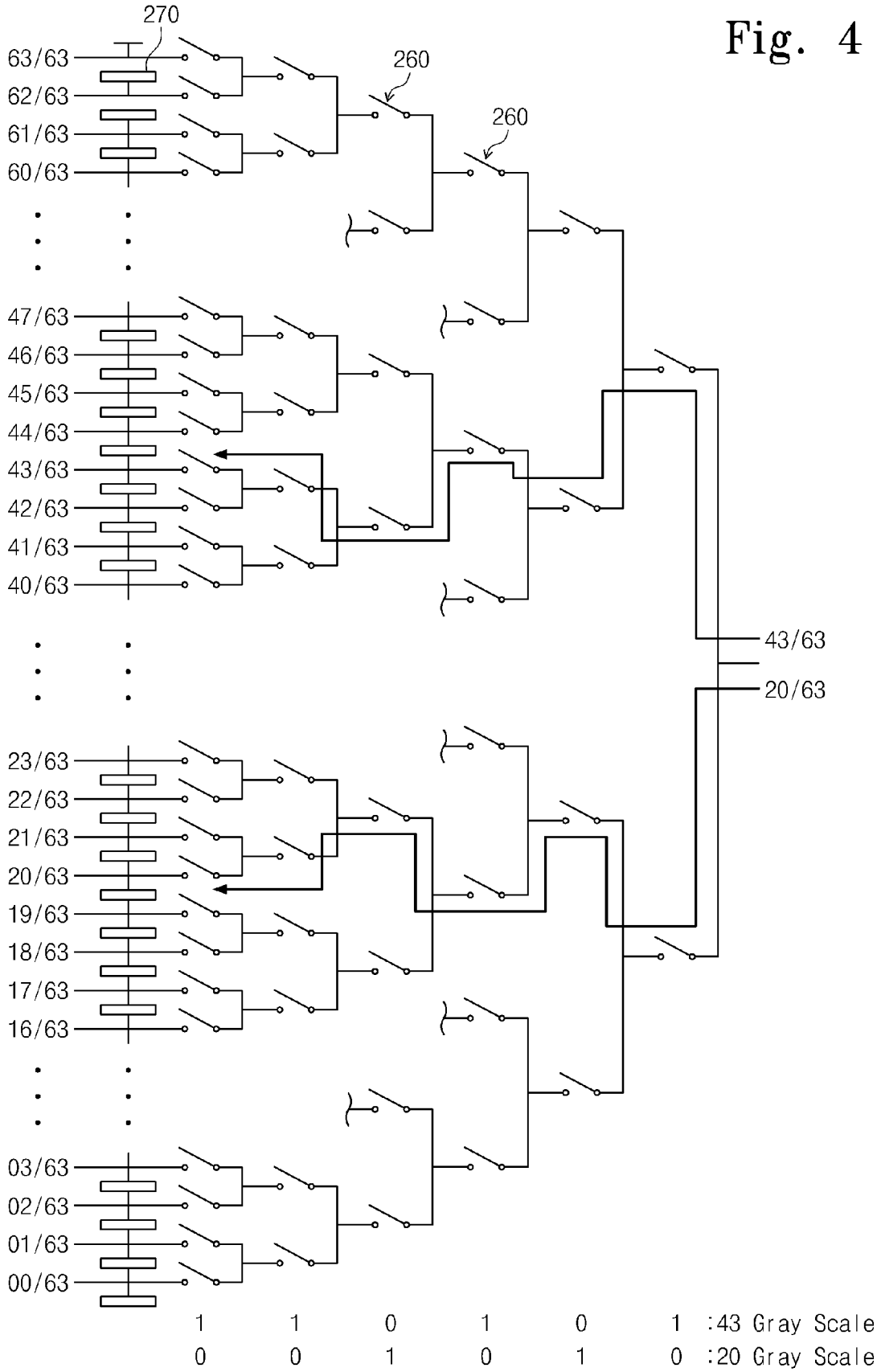
FIG. 4 is an equivalent schematic view illustrating an exemplary embodiment of gray scales of present image data and next image data of the switching signal generating unit shown in FIG. 3.

FIG. 3 is a block diagram showing an exemplary embodiment of a switching signal generating unit of the driving unit shown in FIG. 1, and FIG. 4 is an equivalent schematic view illustrating gray scales of present image data and next image data of the switching signal generating unit FIG. 3.

Referring to FIG. 3, the switching signal generating unit 150 includes an inverter part 110, a comparator 120 and a signal generator 130.

In an exemplary embodiment, the inverter part 110 includes an inverter 111. The inverter part 110 receives present image data data(i) and inverts the present image data data(i) using the inverter 111 to output the inverted image data as inverted image data to predict next image data data(i+1).

In an exemplary embodiment shown in FIG. 4, $2^6=64$ gray scales, e.g., gray scales from 0 to 63, are illustrated, but alternative exemplary embodiments are not limited thereto. Each gray scale of the 64 gray scales has a voltage level difference from each other by a plurality registers 270 connected in series. Each gray scale of the 64 gray scales is associated with a switching device 260 of a plurality of switching devices 260, and each associated switching device 260 is turned on or turned off in response to each bit of 6-bit image data from an external source (not shown). For example, when image data of '101011' are input, the switching devices 260 are turned on corresponding to each bit of the image data, and a voltage corresponding to a forty-third gray scale is outputted as the data voltage.

Moreover, in an exemplary embodiment of the present invention, when the present image data data(i) corresponds to the forty-third gray scale, the present image data data(i) has a positive polarity with respect to the common voltage Vcom, and the inverted image data data(i+1) has a different polarity from the polarity of the present image data data(i) but is displayed in the same gray scale as the present image data data(i), e.g., the inverted image data data(i+1) corresponds to a twentieth gray scale.

Accordingly, when the present image data data(i) of '101011' are inputted to the inverter part 110, the inverter part 110 outputs the inverted image data data(i+1) as '010100', as shown in FIG. 4.

Although the inverted image data data(i+1), e.g., the next image data data(i+1), is not displayed as the same gray scale as the present image data data(i), the inverted image data data(i+1) generated by the inverter part 110 has the same polarity as the next image data data(i+1), and a time during which a voltage level corresponding to the inverted image data data(i+1) reaches a voltage level of the next image data data(i+1) is substantially reduced and/or effectively minimized. Thus, power consumption in an exemplary embodiment is substantially reduced.

As shown in FIG. 3, the comparator 120 receives the inverted image data data(i+1) and the common voltage Vcom and counts the transition period T1 (FIG. 2) of the common voltage Vcom using a predetermined reference clock RCLK. The comparator 120 outputs a comparison signal COM1 when the count value matches the gray scale value of the inverted image data data(i+1) outputted from the inverter part 110.

Figure 5:
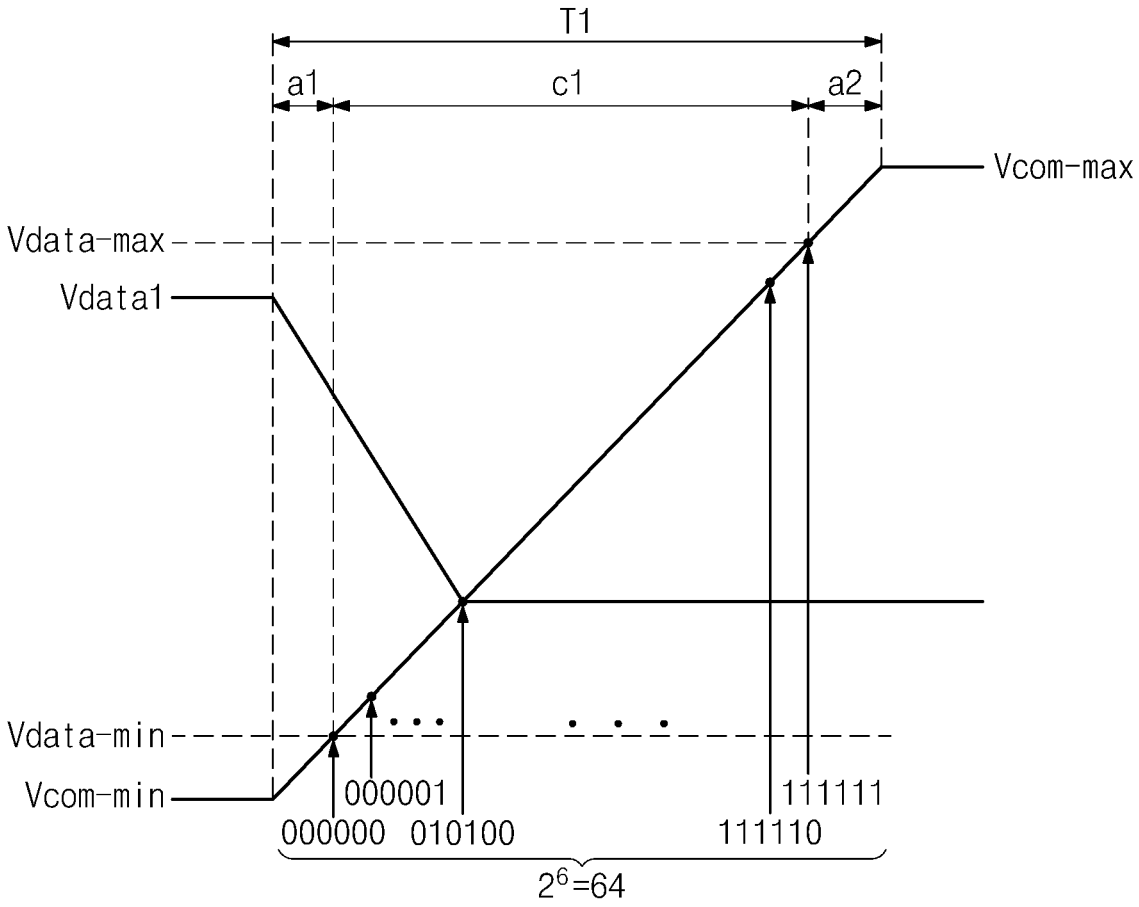
FIG. 5 is a signal timing diagram illustrating an exemplary embodiment of a transition period of a common voltage divided into 64 gray scales.

FIG. 5 is a signal timing diagram illustrating an exemplary embodiment of a transition period of a common voltage divided into 64 gray scales.

As shown in FIG. 5, the transition period T1 of the common voltage Vcom includes a first period a1 from a time point corresponding to a minimum common voltage level Vcom-min to a time point corresponding to a minimum data voltage level Vdata-min, a second period a2 from a time point corresponding to a maximum data voltage level Vdata-max to a time point corresponding to a maximum common voltage level Vcom-max, and a sharing period cl existing between the first and second periods a1 and a2.

The sharing period cl is divided into periods corresponding to the 64 gray scales be represented by the data voltage (e.g., 64 gray scales from 000000 to 111111).

As described above, the earlier half period of the transition period T1 includes a portion of the sharing period cl. The common voltage Vcom may have a same voltage level as a voltage level of the next data voltage Vdata(i+1) at a time point of the sharing period cl which is included in the earlier half period. When charges of the common voltage Vcom are shared with the present data voltage Vdata(i) at the time point, the time required for the present data voltage Vdata(i) to reach the next data voltage Vdata(i+1) is substantially reduced.

To calculate a value of the time point, the comparator 120 compares a count value of the sharing period cl with a gray scale value corresponding to the next data voltage Vdata(i+1). The comparator 120 outputs the comparison signal COM1 at the time point where the count value matches the gray scale value (e.g., at a time point of '010100' corresponding to the gray scale level shown in FIG. 4).

Referring again to FIG. 3, the signal generator 130 generates the first switching signal S1 and the second switching signal S2 based on the comparison signal COM1, and the first switching signal S1 and the second switching signal S2 are applied to the switching circuit 220 in the data driver 230. In an exemplary embodiment, the first switching signal S1 and the second switching signal S2 are 1-bit signals and have opposite values from each other.

In an exemplary embodiment, the first switching signal S1 maintains a logic high state (e.g., a value of "1") during the voltage maintaining period H1 and maintains the logic high state during at least a majority of the transition period T1. In the period during which the count value of the sharing period cl matches the gray scale value corresponding to the next data voltage Vdata(i+1), the first switching signal S1 maintains a logic low state (e.g., a value of "0") in response to the comparison signal COM1. Since the second switching signal S2 has a states opposite to a state of the first switching signal S1, the second switching signal S2 maintains the logic high state only in the period during which the count value of the sharing period cl matches the gray scale value corresponding to the next data voltage Vdata(i+1).

Figure 6:
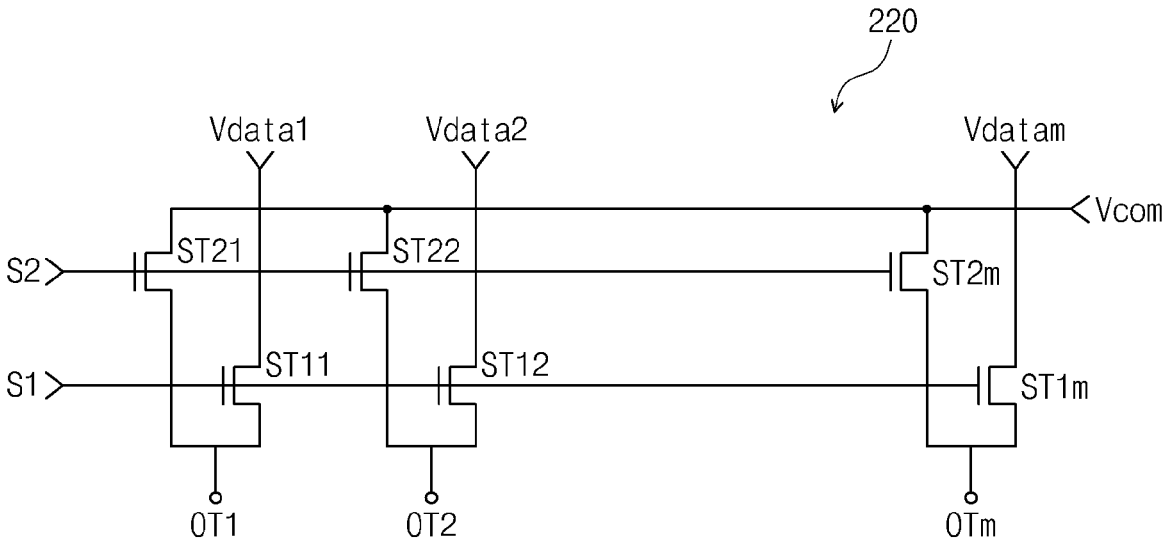
FIG. 6 is a schematic circuit diagram showing an exemplary embodiment of a switching circuit of the driving unit shown in FIG. 1.

FIG. 6 is a schematic circuit diagram showing an exemplary embodiment of a switching circuit of the driving unit shown in FIG. 1.

Referring to FIG. 6, the switching circuit 220 includes a plurality of first switching devices ST11-ST1*m* and a plurality of second switching devices ST21-ST2*m*.

The First switching devices ST11-ST1*m* receive the data voltages Vdata1-Vdatam, respectively, output from the data processor 210 of the data driver 230, and are electrically connected to the output terminals OT1-OTm, respectively, of the data driver 230 (best shown in FIG. 1). More particularly, each of the first switching devices ST11-ST1*m* includes an input electrode which receives a corresponding data voltage of the data voltages Vdata1-Vdatam, an output electrode corresponding to an associated output terminal of the output terminals OT1-OTm, and a control electrode which receives the first switching signal S1.

The second switching devices ST21-ST2*m* receive the common voltage Vcom and are electrically connected to the output terminals OT1-OTm, respectively. More specifically, each of the second switching devices ST21-ST2*m* includes an input electrode which receives the common voltage Vcom, an output electrode connected to a corresponding output terminal of the output terminals OT1-OTm, and a control electrode which receives the second switching signal S2.

As shown in FIG. 3, the first switching signal S1 and the second switching signal s S2 are generated by the signal generator 130 and have phases which are opposite to each other.

The second switching devices ST21-ST2*m* are turned on in response to the second switching signal S2 in a period during which the count value of the sharing period cl matches the gray scale value corresponding to the next data voltage Vdata (i+1). Accordingly, the common voltage Vcom is output through the output terminals OT1-OTm of the data driver 230 instead of the data voltages Vdata1-Vdatam. Moreover, since the first switching devices ST11-ST1*m* are turned off in response to the first switching signal S1, the data voltages Vdata1-Vdatam are not applied to the output terminals OT1-OTm for the period during which the count value of the sharing period cl matches the gray scale value corresponding to the next data voltage Vdata(i+1).

When the first switching signal S1 transitions to the logic high state, the first switching devices ST11-ST1*m* are turned on by the first switching signal S1, and the data voltages Vdata1-Vdatam are outputted through the output terminals OT1-OTm, respectively, of the data driver 230.

As described herein, when the polarity of the data voltage is inverted every horizontal scanning period, a charge of the common voltage which is closer to the next data voltage is shared with that of the present data voltage, and a time during which the present data voltage transitions to the next data voltage is substantially reduced. As a result, current consumption is substantially reduced in the driving unit 250 according to an exemplary embodiment of the present invention.

Figure 7:
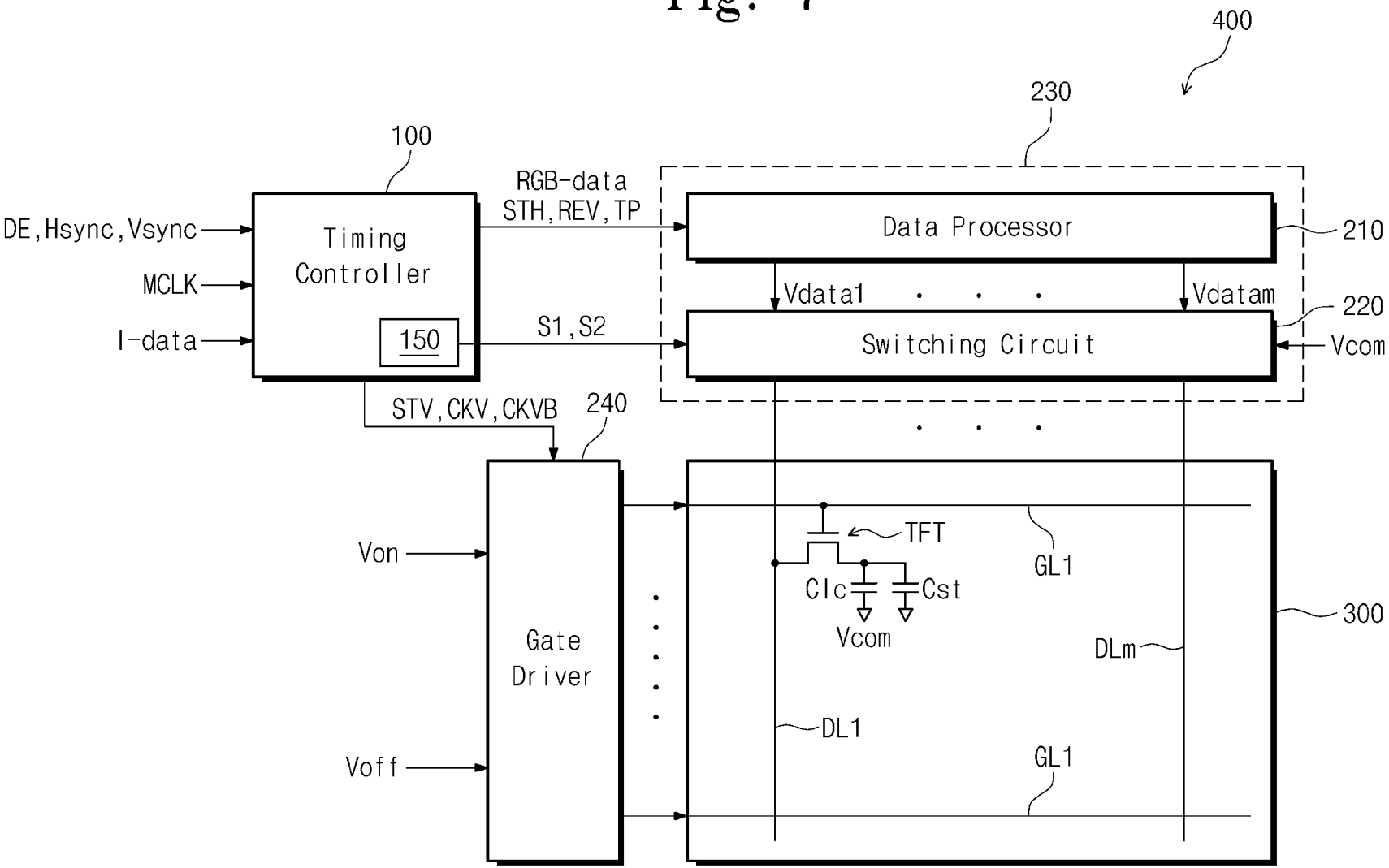
FIG. 7 is a block diagram showing an exemplary embodiment of a liquid crystal display according to the present invention.

FIG. 7 is a block diagram showing an exemplary embodiment of a liquid crystal display according to the present invention. In FIG. 7, the same reference numerals denote the same or like elements as described in greater detail above with reference to FIG. 1, and thus any repetitive detailed descriptions thereof will hereinafter be omitted.

Referring to FIG. 7, a liquid crystal display 400 according to an exemplary embodiment includes a liquid crystal display panel 300 which displays images and a driving unit 250 (FIG. 1) which the liquid crystal display panel 300. The driving unit 250 has substantially the same structure and function as the driving unit 250 described in greater detail above with reference to FIG. 1, and thus any repetitive detailed description of the driving unit 250 will hereinafter be omitted.

The liquid crystal display panel 300 according to an exemplary embodiment includes a plurality of data lines DL1-DLm and a plurality of gate lines GL1-GLn. Data lines DL1-DLm of the plurality of data lines DL1-DLm are insulated from gate lines GL1-GLn of the plurality of gate lines GL1-GLn while crossing the gate lines GL1-GLn. In an exemplary embodiment, the gate lines GL1-GLn and the data lines DL1-DLm define a plurality of pixel areas on the liquid crystal display panel 300. Each pixel area of the plurality of pixel areas includes a pixel having a thin film transistor TFT, a liquid crystal capacitor Clc and a storage capacitor Cst. The thin film transistor TFT includes a source electrode connected to a corresponding data line DL of the data lines DL1-DLm, a gate electrode connected to a corresponding gate line GL of the gate lines GL1-GLn, and a drain electrode connected to a pixel electrode which is an electrode, e.g., a lower electrode, of the liquid crystal capacitor Clc. The liquid crystal capacitor Clc and the storage capacitor Cst are connected to the drain electrode and are in electrical parallel with each other.

The common electrode, which is an electrode, e.g., an upper electrode, of the liquid crystal capacitor Clc, is disposed opposite to, e.g., faces, the pixel electrode. A liquid crystal layer is interposed between the common electrode and the pixel electrode and receives the common voltage Vcom. As shown in FIG. 7, the common voltage Vcom applied to the common electrode is also applied to the switching circuit 220 of the data driver 230.

The data driver 230 is electrically connected to the data lines DL1-DLm arranged on the liquid crystal display panel 300, and the gate driver 240 is electrically connected to the gate lines GL1-GLn arranged on the liquid crystal display panel 300.

The data driver 230 temporarily outputs the common voltage Vcom in response to the second switching signal S2 when the common voltage Vcom has the voltage level corresponding to the next data voltage, and then outputs the data voltages Vdata1-Vdatam during a remaining period in response to the first switching signal S1.

Thus, when the polarity of the data voltage is inverted every gate line, and the common voltage Vcom is outputted at the time point during the transition period of the common voltage Vcom at which the common voltage Vcom has the voltage level closer to the next data voltage, the next data line is precharged to the common voltage Vcom. Therefore, the time required for the present data voltage to be charged to the next data voltage in each pixel is substantially shortened, thereby substantially reducing the current consumption of the liquid crystal display 400 according to an exemplary embodiment of the present invention.

The gate driver 240 sequentially outputs the gate signals to be applied to the gate lines GL1-GLn. Accordingly, the pixels of the liquid crystal display panel 300, connected to the gate lines, are sequentially turned on by pixel rows, and the turned-on pixels thereby receive the data voltages Vdata1-Vdatam from the data driver 230, to display a desired image on the liquid crystal display 400 according to an exemplary embodiment of the present invention.

Thus, according to exemplary embodiments of the present invention as described herein, in a driving unit and a display apparatus having the driving unit, a timing controller outputs a switching signal at a time point in a transition period of a common voltage, at which the common voltage is closest to a voltage level of a next data voltage output from a data processor, and a switching circuit in the data driver outputs a signal to a common electrode at the time point in the transition period.

Accordingly, a transition time of the data voltage is substantially reduced and/or effectively minimized, thereby substantially reducing a current consumption in the display apparatus according to an exemplary embodiment of the present invention.

The present invention should not be construed as being limited to the exemplary embodiments set forth herein. Rather, these exemplary embodiments are provided so that this disclosure will be thorough and complete and will fully convey the concept of the present invention to those skilled in the art. For example, in another alternative exemplary embodiment of the present invention, a method of driving a display apparatus includes: generating an image data, a data control signal, a gate control signal, a gate control signal and a switching signal; converting the image data into a data voltage based on the data control signal; outputting the data voltage in response to a first state of the switching signal; outputting the common voltage at a time point in an earlier half period of a transition period of a common voltage having a predetermined period in response to a second state of the switching signal; outputting a gate signal in response to the gate control signal; precharging a pixel with the common voltage; and applying the data voltage to the pixel in response to the gate signal to display an image corresponding to the data voltage.

Although the present invention has been particularly shown and described herein with reference to exemplary embodiments thereof, it will be understood by those of ordinary skill in the art that various changes in form and details may be made therein without departing from the spirit or scope of the present invention as defined by the following claims.

What is claimed is:

1. A driving unit comprising:

a timing controller which outputs image data, a data control signal, a gate control signal, and a switching signal;

a data driver comprising:

a data processor which converts the image data into a data voltage based on the data control signal; and a switching circuit which receives the data voltage and a common voltage having a predetermined period and outputs at least one of the common voltage and the data voltage in response to the switching signal, the switching circuit comprises a second switching device which provides the common voltage to an output terminal of the data driver based on a second switching signal of the switching signal; and a gate driver which outputs a gate voltage in response to the gate control signal, wherein the timing controller activates the switching signal to a first state at a time point in a first half period of a transition period of the common voltage, and the switching circuit outputs the common voltage when the switching signal is activated to the first state, wherein the switching signal generating unit comprises:

an inverter which inverts a first image data corresponding to a present data line of the timing controller to output a second image data;

a comparator which compares a voltage level of the second image data with a voltage level of the common voltage and outputs a comparison signal at a time point when the voltage level of the common voltage corresponds to the voltage level of the second image data in the transition period of the common voltage; and a signal generator which provides the second switching signal to the second switching device based on the comparison signal.

2. The driving unit of claim 1, wherein a phase of the data voltage is opposite to a phase of the common voltage, and a polarity of the data voltage with respect to the common voltage is inverted each gate line.

3. The driving unit of claim 2, wherein an amplitude of the common voltage is greater than an amplitude of the data voltage.

4. The driving unit of claim 3, wherein the transition period of the common voltage comprises:

a first period extending from a time point corresponding to a minimum common voltage level to a time point corresponding to a minimum data voltage level;

a second period extending from a time point corresponding to a maximum data voltage level to a time point corresponding to a maximum common voltage level; and a sharing period between the first period and the second period, wherein the time point of the first half period of the transition period of the common voltage is in the sharing period.

5. The driving unit of claim 4, wherein the sharing period is divided into periods corresponding to gray scales of the data voltage, and the time point corresponds to a point at which the common voltage has a level equal to a gray scale level of an inverted data voltage corresponding to a present data line.

6. The driving unit of claim 1, wherein the switching circuit further comprises:

a first switching device which provides the data voltage to then output terminal of the data driver based on a first switching signal of the switching signal, wherein a phase of the second switching signal is opposite to a phase of the first switching signal.

7. The driving unit of claim 6, wherein the timing controller comprises a switching signal generating unit which generates the first switching signal and the second switching signal and provides the first switching signal and the second switching signal to the switching circuit.

8. The driving unit of claim 7, wherein the comparator determines a count value based on the transition period of the common voltage using a predetermined reference clock and outputs the comparison signal to the signal generator when the count value corresponds to a gray scale value of the second image data.

9. The driving unit of claim 1, wherein the switching circuit comprises:

an inverter which inverts a first image data corresponding to a present data line of the timing controller to output a second image data;

a comparator which compares a voltage level of the second image data with a voltage level of the common voltage and outputs a comparison signal at a time point when the voltage level of the common voltage corresponds to the voltage level of the second image data in the transition period of the common voltage; and a signal generator which activates the switching signal to the first state based on the comparison signal.

10. The driving unit of claim 9, wherein the comparator determines a count value based on the transition period of the common voltage using a predetermined reference clock and outputs the comparison signal to the signal generator when the count value corresponds to a gray scale value of the second image data.

11. The driving unit of claim 9, wherein the switching circuit further comprises:

a first switching device which provides the data voltage to an output terminal of the data driver based on a first switching signal;

a second switching device which provides the common voltage to the output terminal of the data driver based on the switching signal, wherein a phase of the first switching signal is opposite to a phase of the switching signal.

12. A display apparatus comprising:

a timing controller which outputs an image data, a data control signal, a gate control signal, and a switching signal;

a data driver comprising;

a data processor which converts the image data into a data voltage based on the data control signal; and a switching circuit which receives the data voltage and a common voltage having a predetermined period and outputs at least one of the common voltage and the data voltage in response to the switching signal, the switching circuit comprises a second switching device which provides the common voltage to the output terminal based on a switching signal of the switching signal;

a gate driver which outputs a gate voltage in response to the gate control signal; and a display panel including a pixel and which receives the data voltage from the switching circuit in response to the gate voltage and charges the data voltage into the pixel to display an image, wherein the timing controller activates the switching signal to a first state in a first half period of a transition period of the common voltage, and the switching circuit outputs the common voltage when the switching signal is activate the first state to precharge the pixel, wherein the switching signal generating unit comprises:

an inverter which inverts a first image data corresponding to a present data line of the timing controller to output a second image data;

a comparator which compares a voltage level of the second image data with a voltage level of the common voltage and outputs a comparison signal at a time point when the voltage level of the common voltage corresponds to the voltage level of the second image data in the transition period of the common voltage; and a signal generator which provides the second switching signal to the second switching device based on the comparison signal.

13. The display apparatus of claim 12, wherein a phase of the data voltage is opposite to a phase of the common voltage, and a polarity of the data voltage with respect to the common voltage is inverted each gate line.

14. The display apparatus of claim 13, wherein an amplitude of the common voltage is greater than an amplitude of the data voltage.

15. The display apparatus of claim 14, wherein the transition period comprises:

a first period extending from a time point corresponding to a minimum common voltage level to a time point corresponding to a minimum data voltage level;

a second period extending from a time point corresponding to a maximum data voltage level to a time point corresponding to a maximum common voltage level; and a sharing period between the first period and the second period, wherein the time point of the first half period of the transition period of the common voltage is in the sharing period.

16. The display apparatus of claim 15, wherein the sharing period is divided into periods corresponding to gray scales of the data voltage, and the time point corresponds to a point at which the common voltage has a level equal to a gray scale level an inverted data voltage corresponding to a present data line.

17. The display apparatus of claim 12, wherein the switching circuit further comprises:

a first switching device which provides the data voltage to an output terminal of the data driver based on a first switching signal of the switching signal;

wherein a phase of the second switching signal is opposite to a phase of the first switching signal.

18. The display apparatus of claim 17, wherein the timing controller comprises a switching signal generating unit which generates the first switching signal and the second switching signal and provides the first switching signal and the second switching signal to the switching circuit.

19. The display apparatus of claim 18, wherein the comparator determines a count value based on the transition period of the common voltage using a predetermined reference clock and outputs the comparison signal to the signal generator when the count value corresponds to a gray scale value of the second image data.

20. A method of driving a display apparatus, the method comprising:

generating an image data, a data control signal, a gate control signal and a switching signal;

converting the image data into a data voltage based on the data control signal;

outputting the data voltage in response to a first state of the switching signal;

outputting the common voltage at a time point in an earlier half period of a transition period of a common voltage having a predetermined period in response to a second state of the switching signal;

outputting a gate signal in response to the gate control signal;

precharging a pixel with the common voltage; and applying the data voltage to the pixel in response to the gate signal to display an image corresponding to the data voltage, wherein the generating of the switching signal comprises:

converting a first image data corresponding to a present data line to output a second image data;

comparing a voltage level corresponding to the second image data with a voltage level of the common voltage to output a comparison signal at a time point where a level of the common voltage corresponds to a level of the second image data during the transition period of the common voltage; and outputting the switching signal based on the comparison signal.

21. The method of claim 20, wherein a phase of the data voltage is opposite to a phase of the common voltage, an amplitude of the data voltage is less than an amplitude of the common voltage, and a polarity of the data voltage with respect to the common voltage is inverted each gate line.

22. The method of claim 21, wherein the transition period comprises:

a first period extending from a time point corresponding to a minimum common voltage level to a time point corresponding to a minimum data voltage level;

a second period extending from a time point corresponding to a maximum data voltage level to a time point corresponding to a maximum common voltage level Vcommin; and a sharing period between the first period and the second period, wherein the time point of the first half period of the transition period of the common voltage is in the sharing period.

23. The method of claim 22, wherein the sharing period is divided into periods corresponding to gray scales of the data voltage, and the time point corresponds to a point at which the common voltage has a level equal to a gray scale level of an inverted data voltage corresponding to a present data line.

* * * * *